US011161316B2

(12) United States Patent
Brunner et al.

(10) Patent No.: US 11,161,316 B2
(45) Date of Patent: Nov. 2, 2021

(54) METHOD FOR PRESSING A WORKPIECE WITH A PREDETERMINED PRESSING FORCE

(71) Applicant: STIWA Holding GmbH, Attnang-Puchheim (AT)

(72) Inventors: Matthias Brunner, Voecklabruck (AT); Tobias Glueck, Vienna (AT); August Gruendl, Schoerfling (AT); Andreas Kugi, Vienna (AT); Josef Meingassner, Hohenzell (AT); Michael Pauditz, Schwanenstadt (AT)

(73) Assignee: STIWA Holding GmbH, Attnang-Puchheim (AT)

( * ) Notice: Subject to any disclaimer, the term of this patent is extended or adjusted under 35 U.S.C. 154(b) by 404 days.

(21) Appl. No.: 16/305,558

(22) PCT Filed: May 31, 2017

(86) PCT No.: PCT/AT2017/060143
§ 371 (c)(1),
(2) Date: Nov. 29, 2018

(87) PCT Pub. No.: WO2017/205888
PCT Pub. Date: Dec. 7, 2017

(65) Prior Publication Data

US 2020/0324503 A1 Oct. 15, 2020

(30) Foreign Application Priority Data

Jun. 1, 2016 (AT) ..... A 50502/2016

(51) Int. Cl.
*B30B 15/14* (2006.01)
*B30B 1/18* (2006.01)
(Continued)

(52) U.S. Cl.
CPC ..... *B30B 15/148* (2013.01); *B30B 1/181* (2013.01); *B30B 15/186* (2013.01); *B30B 15/26* (2013.01)

(58) Field of Classification Search
CPC ..... B30B 1/183; B30B 1/186; B30B 15/14; B30B 15/148; B30B 15/181; B30B 15/20;
(Continued)

(56) References Cited

U.S. PATENT DOCUMENTS 4,712,048 A * 12/1987 Rebsamen ..... G05B 19/186 318/41
5,587,633 A 12/1996 Aoki et al.
(Continued)

FOREIGN PATENT DOCUMENTS

CN 1366486 A 8/2002
DE 196 06 842 A1 8/1996
(Continued)

OTHER PUBLICATIONS

International Search Report of PCT/AT2017/060143, dated Oct. 19, 2017.
(Continued)

*Primary Examiner* — Edward T Tolan
*Assistant Examiner* — Katie L. Parr
(74) *Attorney, Agent, or Firm* — Collard & Roe, P.C.

(57) ABSTRACT

A method for pressing a workpiece with a predetermined pressing force uses a forming tool coupled with an electric motor via a spindle drive that converts the rotational movement of the electric motor drive shaft to a translational movement of the forming tool. The method includes: accelerating the electric motor in a first rotational direction to a predetermined maximal speed of rotation; operating the electric motor at the maximal speed until the drive shaft has completed a predetermined number of revolutions; reducing
(Continued)

Figure 1:
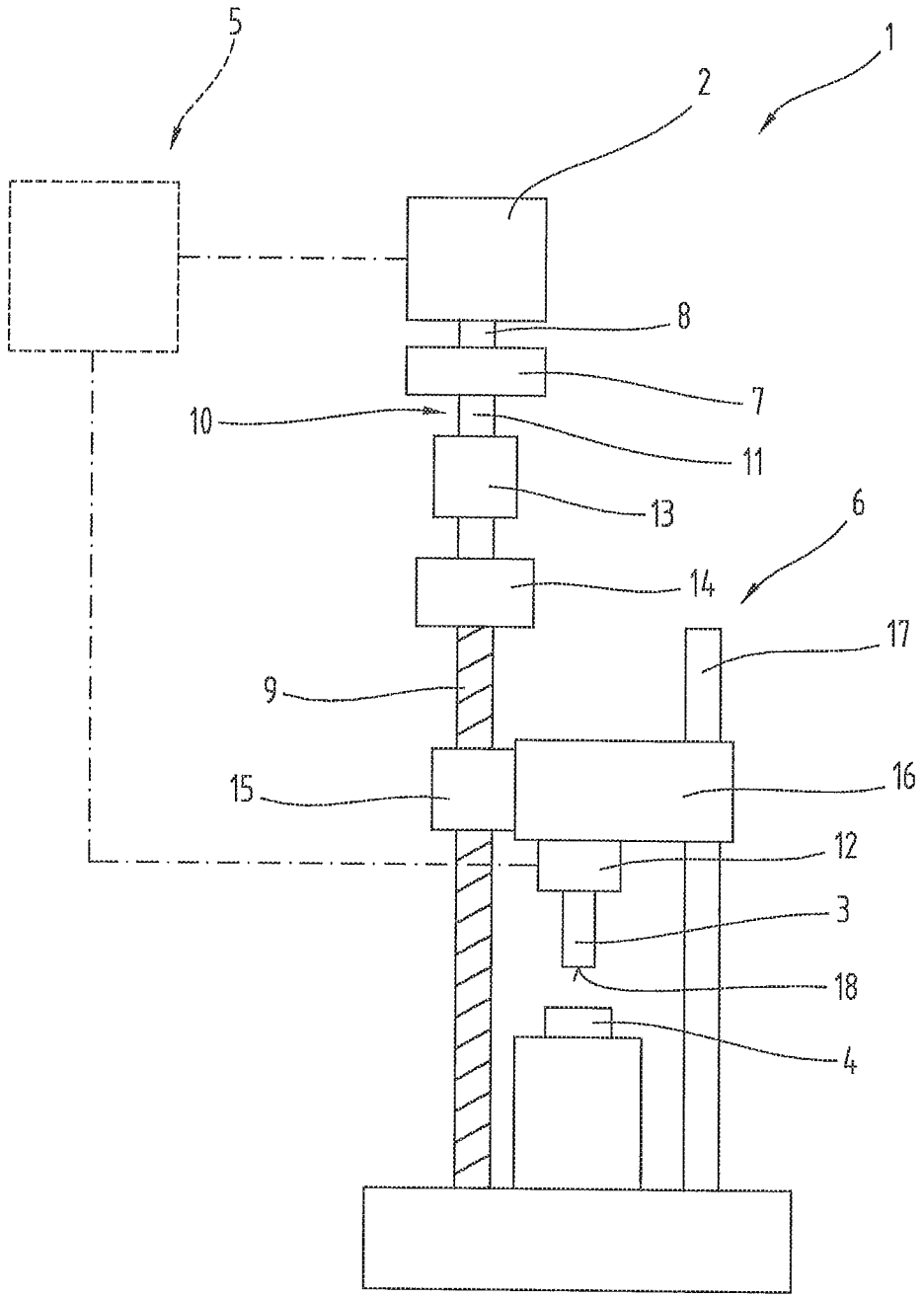

the speed of rotation of the electric motor to a predetermined reduced speed of rotation; operating the electric motor at the reduced speed until a pressing force increase exceeding a predetermined threshold value is detected by a measuring unit that follows the electric motor; forming the workpiece with constant detection of the pressing force by the measuring unit until the predetermined pressing force has been reached.

13 Claims, 9 Drawing Sheets

(51) Int. Cl.
*B30B 15/18* (2006.01)
*B30B 15/26* (2006.01)

(58) Field of Classification Search
CPC ..... B30B 15/22; B30B 15/26; B30B 15/166; B23Q 17/005; B23Q 5/12; G05B 13/04; G05B 17/00; G05B 17/02; G05B 2219/2622; G05B 2219/37357; G05B 2219/45143; G05B 2219/49004
USPC ..... 72/20.4, 21.4; 700/165
See application file for complete search history.

(56) References Cited

U.S. PATENT DOCUMENTS

| | | | | |
|---|---|---|---|---|
| 5,746,122 | A * | 5/1998 | Gietz | B30B 15/0041 100/257 |
| 8,393,264 | B2 | 3/2013 | Inoue et al. | |
| 9,778,624 | B2 | 10/2017 | Ueda | |
| 10,442,149 | B2 * | 10/2019 | Nomura | H02K 11/33 |
| 10,948,882 | B2 * | 3/2021 | Acosta Gonzalez | G05B 13/04 |
| 11,072,314 | B2 * | 7/2021 | Feigel | B60T 8/4081 |
| 2002/0134256 | A1 | 9/2002 | Futamura et al. | |
| 2006/0012326 | A1 * | 1/2006 | Iwashita | G05B 19/416 318/645 |
| 2011/0132209 | A1 * | 6/2011 | Senda | G05B 19/19 100/35 |
| 2016/0221217 | A1 * | 8/2016 | Lunstedt | B30B 11/02 |
| 2021/0213935 | A1 * | 7/2021 | Lu | B60W 30/02 |

FOREIGN PATENT DOCUMENTS

| | | | | |
|---|---|---|---|---|
| DE | 195 45 004 | A1 | 6/1997 | |
| DE | 10 2007 030 016 | A1 | 1/2008 | |
| DE | 11 2014 002 002 | T5 | 12/2015 | |
| EP | 0 206 984 | A2 | 12/1986 | |
| EP | 1406136 | A1 * | 4/2004 | G05B 13/04 |
| EP | 1 902 792 | A2 | 3/2008 | |
| EP | 2 233 282 | A2 | 9/2010 | |
| JP | H11104899 | A * | 4/1999 | B30B 15/0094 |
| JP | 2016172315 | A * | 9/2016 | |

OTHER PUBLICATIONS

Letter of Austrian Patent Attorney to European Office Action in PCT/AT2017/060143, dated Mar. 29, 2018, with English translation of relevant parts.

* cited by examiner

METHOD FOR PRESSING A WORKPIECE WITH A PREDETERMINED PRESSING FORCE

CROSS REFERENCE TO RELATED APPLICATIONS

This application is the National Stage of PCT/AT2017/060143 filed on May 31, 2017, which claims priority under 35 U.S.C. § 119 of Austrian Application No. A 50502/2016 filed on Jun. 1, 2016, the disclosure of which is incorporated by reference. The international application under PCT article 21(2) was not published in English.

DE 19606842 A1 discloses a method for pressing a workpiece, wherein a pressing punch is provided, which is coupled with a drive motor by means of a gear mechanism. The drive motor is first accelerated to a maximal speed during the pressing process, and subsequently braked to a reduced speed. During operation of the drive motor at the reduced speed of rotation, the electrical variables of the drive motor are monitored so as to detect the torque applied to the drive motor.

The invention relates to a method for pressing a workpiece with a predetermined pressing force.

Different methods for pressing a workpiece are known from the state of the art. The methods known from the state of the art particularly relate to production facilities in which workpieces are supposed to be pressed with a predetermined pressing force. In this regard, the workpieces must be pressed with a predetermined pressing force, wherein the actual amount of the pressing force has only a slight tolerance range.

The methods known from the state of the art have the disadvantage that in order to achieve the required pressing force with adherence to the required tolerance range, the pressing speed must be selected to be correspondingly low, so as to prevent dynamic effects that distort the pressing force due to the mass inertia of the individual components of the drive train.

It was the task of the present invention to overcome the disadvantages of the state of the art and to make available a method that demonstrates increased process speed while simultaneously maintaining the process accuracy.

This task is accomplished by means of an apparatus and a method according to claim 1.

According to the invention, a method is provided for pressing a workpiece with a predetermined pressing force by means of a forming tool, which is coupled with an electric motor by way of a threaded drive. A threaded drive converts the rotational movement of a drive shaft of the electric motor to a translational movement of the forming tool. The electric motor is controlled by a regulator. The method comprises the following method steps:

- accelerating the electric motor in a first direction of rotation, to a predetermined maximal speed of rotation, whereby the forming tool is moved toward the workpiece;
- operating the electric motor at the maximal speed of rotation until the drive shaft of the electric motor has completed a predetermined number of spindle revolutions or the forming tool has reached a predetermined position, wherein during this method step, the forming tool is freely moved toward the workpiece, without touching it;
- reducing the speed of rotation of the electric motor to a predetermined reduced speed of rotation;

- operating the electric motor at the reduced speed of rotation until a pressing force increase is detected by a measuring unit that follows the electric motor, which increase exceeds a predetermined threshold value, or a torque increase is detected at the electric motor, which increase exceeds a predetermined threshold value, wherein the pressing force increase occurs when the forming tool comes to lie against the workpiece to be formed;
- forming the workpiece with constant detection of the pressing force by means of the measuring unit or of the torque at the electric motor, until the predetermined pressing force has been reached.

An advantage of the method according to the invention lies in that the method is divided up into the most varied method steps, wherein the electric motor has a different speed in the individual method steps. By means of this measure, the result is achieved that the pressing time can be shortened as much as possible and, at the same time, the required pressing force can be achieved as precisely as possible. In particular, when operating the electric motor at a predetermined maximal speed of rotation, the fastest application of the forming tool is guaranteed. In this method step, the forming tool is moved in the direction of the workpiece, wherein attention is paid to ensure that the forming tool is moved freely toward the workpiece, and the forming tool does not yet lie against the workpiece. Only in the subsequent method step, during which the electric motor is operated at a reduced speed of rotation, is it provided that the forming tool comes to lie against the workpiece to be processed. As an alternative to a spindle drive, some other means can also be used, which is suitable for converting the rotational movement of the electric motor to a translational movement of the forming tool. The predetermined position of the forming tool can be detected by means of a linear measuring unit, for example. The torque increase in the electric motor can be detected by means of detection of the motor current in the electric motor, for example.

Furthermore, it can be practical if, after detection of the pressing force increase, the electric motor is braked to a predetermined minimal speed of rotation. It is advantageous, in this regard, that excessive pressing and thereby exceeding the pressing force can be prevented by braking the electric motor to a minimal speed.

Furthermore, it can be provided that the electric motor is operated at a minimal speed of rotation for a predetermined or predeterminable period of time, until vibrations that occur in the drive system due to the braking process from the reduced speed of rotation to the minimal speed of rotation have died out, to the greatest possible extent. It is advantageous, in this regard, that by operating the electric motor at the minimal speed of rotation during a predetermined time period, the result can be achieved that the drive system can stop vibrating, and therefore no distortion of the measured pressing force at the measuring unit comes about. In extreme cases, it can be necessary that a complete stop is selected as the minimal speed of rotation. The vibrations that must die out occur due to the mass inertia or the inertia forces of the individual components in the drive system and due to the abrupt braking maneuver.

Furthermore, it can be provided that during forming of the workpiece, control of the electric motor is predetermined by the regulator on the basis of the pressing force measured in the measuring unit. After expiration of this predetermined time period, during which the sensor signal is distorted, it is possible to switch over to pressing force regulation, so as to be able to achieve the required pressing force.

An embodiment according to which it can be provided that the reduced speed of rotation amounts to between 0.1% and 100%, in particular between 0.5% and 99%, preferably between 50% and 80% of the maximal speed of rotation is also advantageous. In this regard, it is advantageous that during operation of the electric motor at a reduced speed of rotation, a pressing force that exceeds a predetermined threshold value can be detected, and, due to the reduced speed of rotation, subsequently sufficient time remains so as to further lower the speed of rotation and to set the required pressing force.

According to a further development, it is possible that immediately after detection of the pressing force increase, further control of the electric motor is predetermined by the regulator on the basis of the pressing force, wherein after detection of the pressing force increase, the electric motor is braked to a predetermined minimal speed of rotation, and during an initial period during the braking process, the pressing force detected in the measuring unit has a pressing force based on a model calculation superimposed on it, and after the initial period, the pressing force detected by the measuring unit serves as the input variable for regulation. This alternative variant has the advantage that the method time can be further shortened and optimized. By means of the superimposition onto the detected pressing force of a pressing force based on a model calculation, the measurement error that occurs due to vibration of the system after the braking procedure of the electric motor can be balanced out.

Furthermore, it can be practical if the mass inertia and/or the spring stiffness and/or the damping and the angular or linear accelerations of the individual components built into the drive train is/are taken into consideration. It is advantageous, in this regard, that on the basis of these values or on the basis of these status variables, the dynamic behavior of the drive train can be precisely calculated, and thereby a distortion of the measured pressing force during braking or during acceleration of the electric motor can be balanced out.

Furthermore, it can be provided that the model calculation is adapted on the basis of the previous cycles, in each instance, using an iterative learning process, wherein for adaptation of the model calculation, the Time Progression of the measured value of the torque in the measuring unit, as well as of the motor moment and of the related angle of rotation of the drive shaft in the electric motor are used. It is advantageous, in this regard, that the drive method can be adapted and improved during ongoing operation, and thereby the precision for achieving the pressing force can be increased, and furthermore the process time can be further shortened.

Furthermore, it can be provided that an interference variable observer, in particular a Kalman filter, is used for the model calculation, with regulation based on the observer also taking place in the first step, and that superimposition onto the force detected in the measuring unit only takes place after a specific point in time. It is advantageous, in this regard, that such an interference variable observer can estimate the actual force applied, on the basis of the setting variable and the sensor signals, and that the estimated external force can be preset for the regulator, whereby the precision in achieving the predetermined pressing force can be improved.

It can furthermore be provided to expand the regulation circuit with a pre-controller for compensation of force and/or inertia, if the dynamics of the subordinate regulators are not sufficient. The pre-controllers can be derived using mathematical models. It can be sufficient to use a greatly simplified model, such as a pure rigid-body system, which takes only the inertia moments and no dynamic elements into consideration, for this purpose. Alternatively to this, a dynamic system, as it is described in this document, can be used for formation of a mathematical model.

Furthermore, it can be provided that a Piezo sensor is used as a measuring unit, which sensor is disposed in the region of the forming tool, so as to detect the pressing force. It is advantageous, in this regard, that a Piezo sensor demonstrates great measurement accuracy, on the one hand, and furthermore demonstrates very rapid response behavior.

Furthermore, it can be provided that immediately after detection of the pressing force increase, further control of the electric motor is predetermined by the regulator on the basis of a reference trajectory of the pressing force value, wherein the progression of the speed of rotation is calculated in a pre-controller, from the reference trajectory of the pressing force value. If an interference value observer is used, the actual force in effect can be estimated. Interference can be eliminated by superimposition onto this estimated force.

Furthermore, it can be provided that in a first phase after detection of the pressing force increase, the pressing force value is estimated by means of an interference variable observer, and that in a second phase after detection of the pressing force increase, the pressing force is detected directly by the measuring unit, and serves as an input variable for regulation. By presetting the pressing force value by means of the interference variable observer, vibrations or interference in the system can be filtered out, so that no variation occurs in regulation. After the vibrations have died out, subsequently the torque actually measured at the measuring unit can serve as an input variable for regulation.

Furthermore, it can be provided that the transition between different speeds of rotation of the individual method steps is predetermined in such a manner that no sudden increases in acceleration occur. By avoiding sudden increases in acceleration, the jolts that act on the individual components of the press can be reduced, and thereby the useful lifetime of the press can be increased.

The maximal speed of rotation to which the electric motor is accelerated does not necessarily need to correspond to the maximally possible speed of rotation of the electric motor. Instead, it is also possible that the maximal speed of rotation results from the process parameters and is a value determined by calculations. In this regard, the predetermined maximal speed of rotation can vary from one pressing process to the next.

Furthermore, it can be provided that a low-pass filter of the third order, having the form $$R_F(s) = \frac{k_{FP}}{\left(1 + \frac{s}{\omega_{Fg}}\right)^3}$$

is selected as a regulator.

Furthermore, it can be provided that regulator parameters can be set using a Loop Shaping method.

The threshold value of the pressing force or of the torque that is detected can be a predetermined or individually predeterminable absolute value of the pressing force, for example in N, or of the torque, for example in Nm.

Alternatively to this, it is also possible that it is not an absolute value of the pressing force or of the torque that is preset as a threshold value, but rather that a predetermined or individually predeterminable pressing force increase per displacement path of the forming tool (wherein the displacement path can be measured directly at the forming tool, or can be calculated by way of the number of revolutions of the drive motor) or torque increase per unit of angle of rotation of the motor is preset as a threshold value. The threshold value of the pressing force increase can be defined, for example, in N per mm displacement path or in N per degree of angle of rotation of the electric motor. The threshold value of the torque increase can be defined, for example, in Nm per degree of angle of rotation.

In yet another embodiment variant, it is conceivable that a maximal change of the pressing force increase per displacement path of the forming tool (wherein the displacement path can be measured directly at the forming tool, or can be calculated by way of the number of revolutions of the drive motor) or of the torque increase per unit of angle of rotation of the motor is preset as a threshold value. The maximal change of the pressing force increase per unit of angle of rotation can be calculated, for example, by means of the first derivation of the function of the pressing force increase per displacement path unit of the forming tool. This threshold value of the change of the torque increase can be defined, for example, in ΔN per Δmm of displacement path. The maximal change of the torque increase per unit of angle of rotation can be calculated, for example, by means of the first derivation of the function of the torque increase per unit of angle of rotation of the motor. This threshold value of the change of the torque increase can be defined, for example, in ΔNm per Δ° of the angle of rotation. In the sense of this document, regulation can be understood to mean two-degrees-of-freedom force regulation with subordinate motor regulation, wherein a regulation circuit with this regulation can also have additional pre-controllers.

Furthermore, it can be provided that a speed of rotation progression is calculated on the basis of the characteristic line for load and a desired reference trajectory for the external pressing force. This speed ties in at the reduced speed of rotation and is changed over to a standstill. With this speed of rotation profile, it is ensured that the external pressing force follows the desired reference trajectory sufficiently well. As a result, it is subsequently possible to balance out the remaining regulation deviation using a linear regulator $R_F$. If an interference variable observer is used, then regulation takes place to the estimated signal, and superimposition onto the measured signal takes place at the end of the trajectory. If the interference variable observer is not present, because the quality of the measured signal is sufficiently good, then regulation to the measured signal takes place directly, and therefore no superimposition is carried out.

For a better understanding of the invention, it will be explained in greater detail using the following figures.

Figure 2:
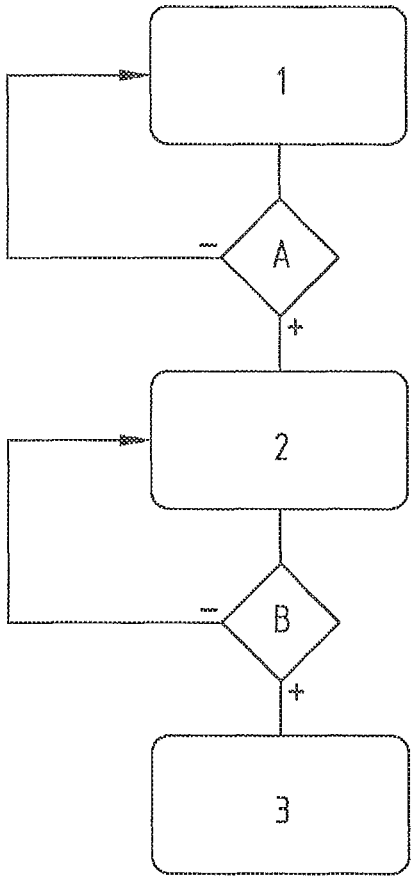
Figure 3:
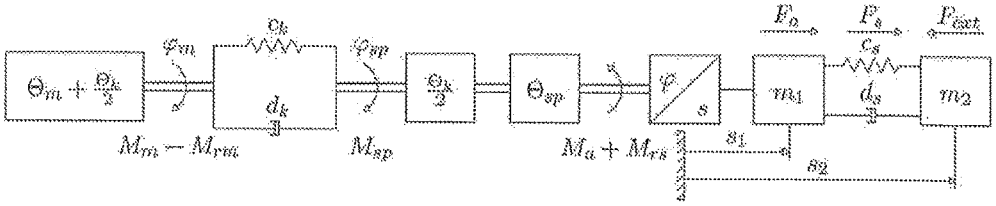
Figure 4:
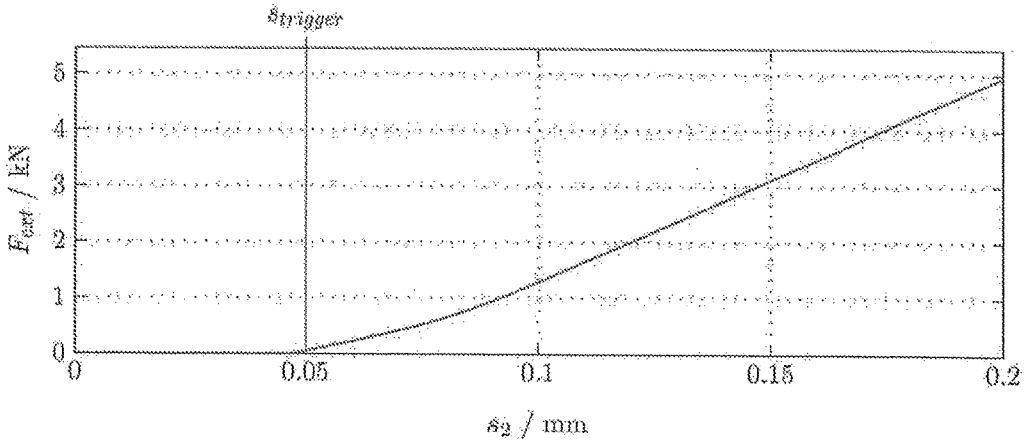
Figure 5:
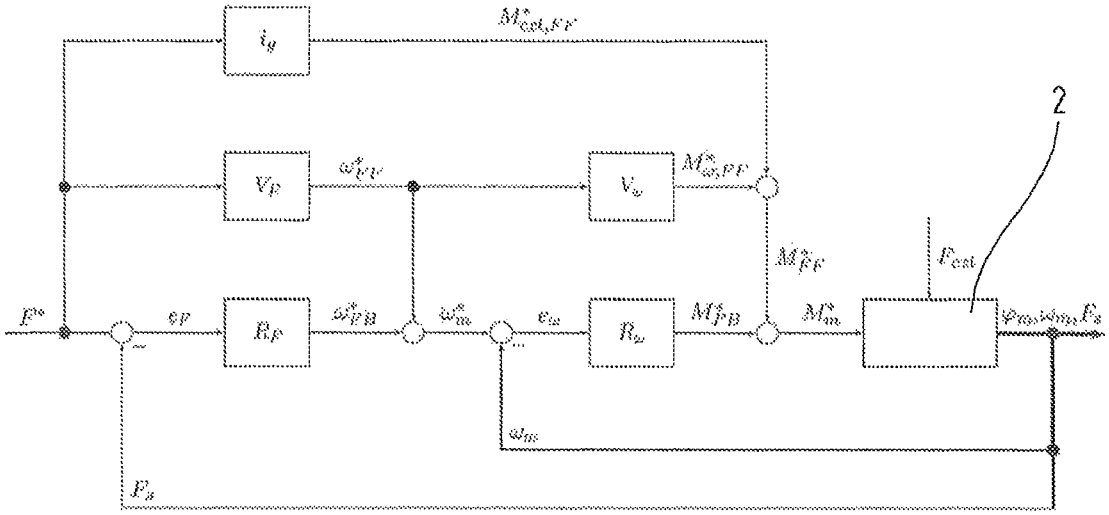
Figure 6:
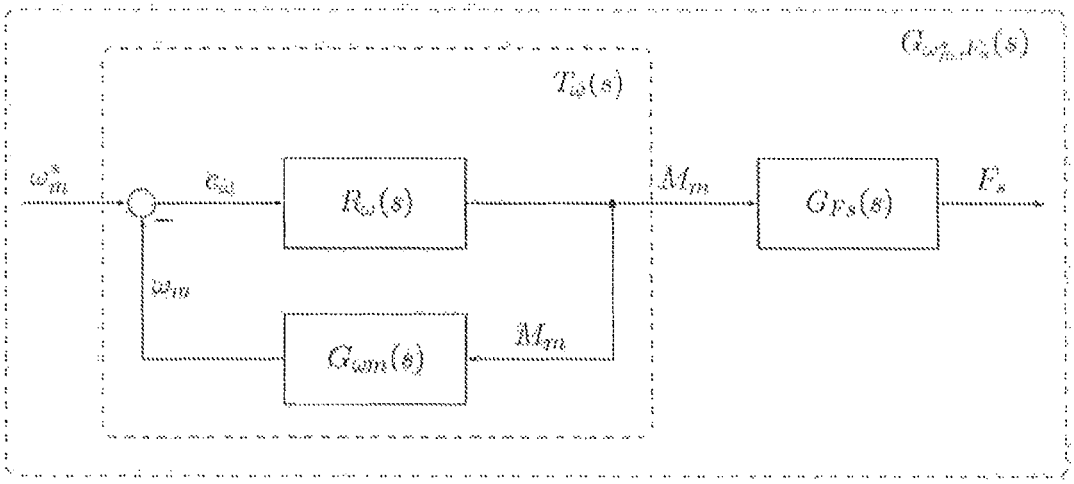
Figure 7:
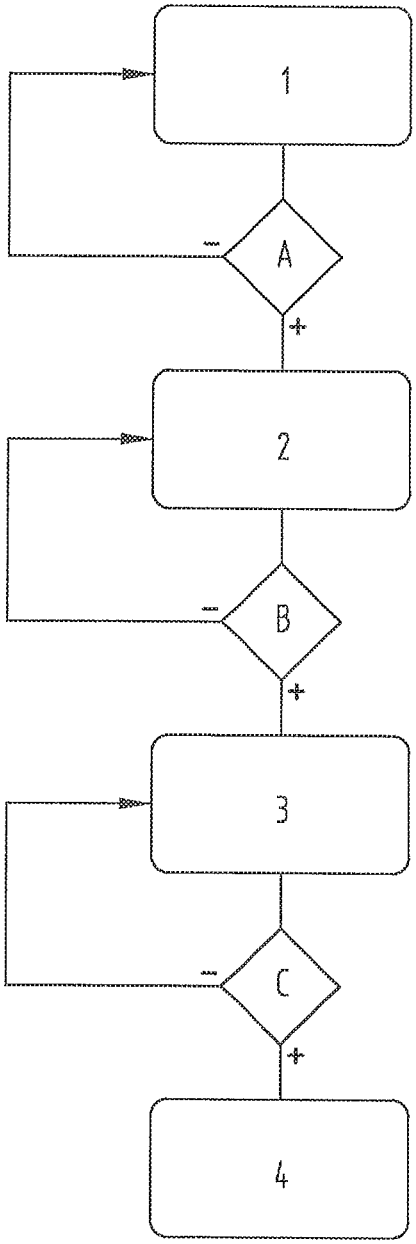
Figure 8:
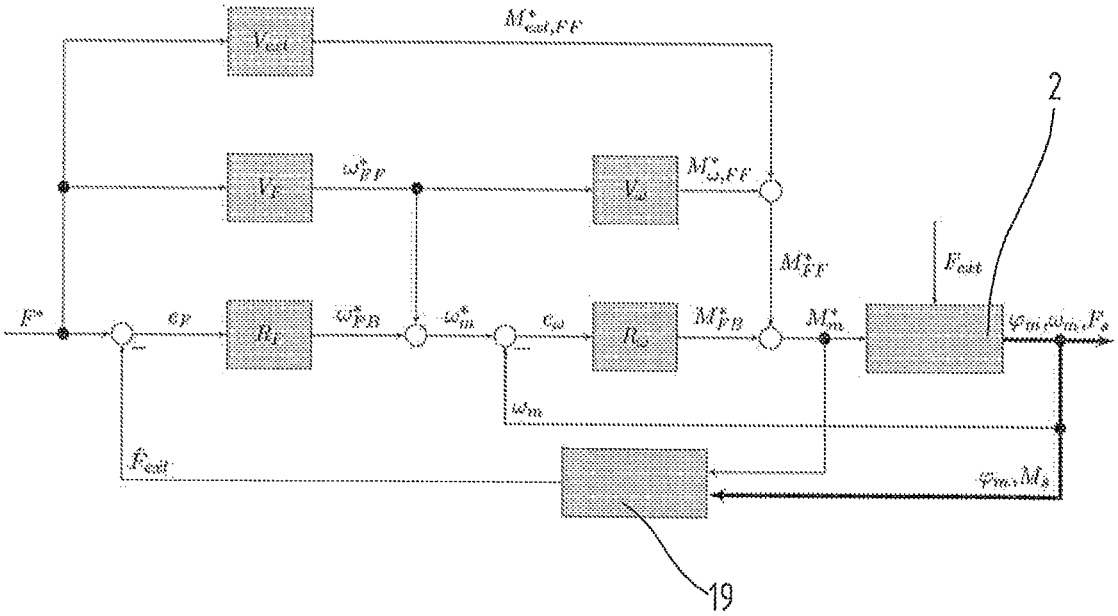
Figure 9:
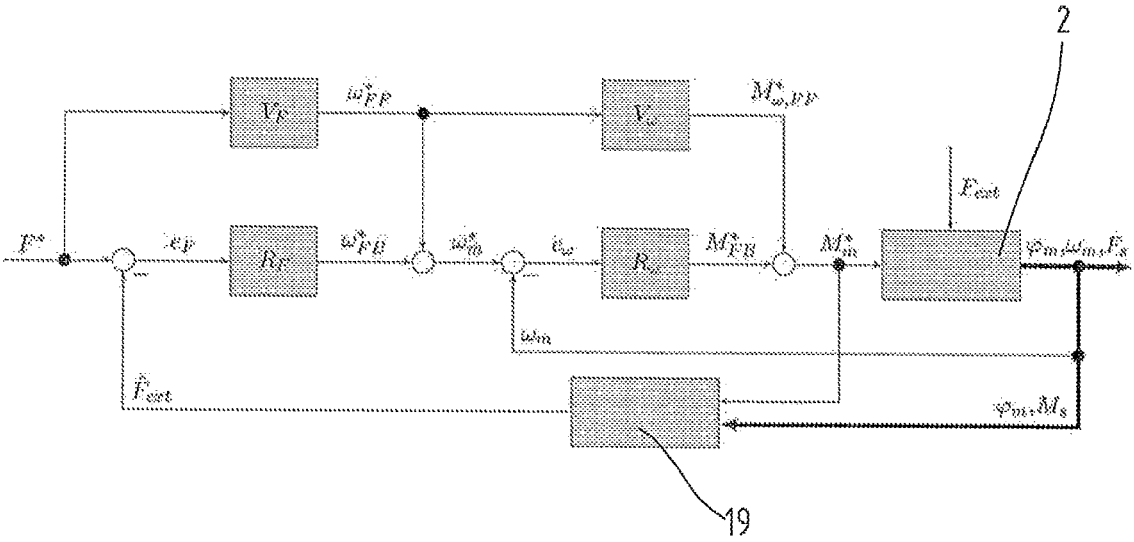
Figure 10:
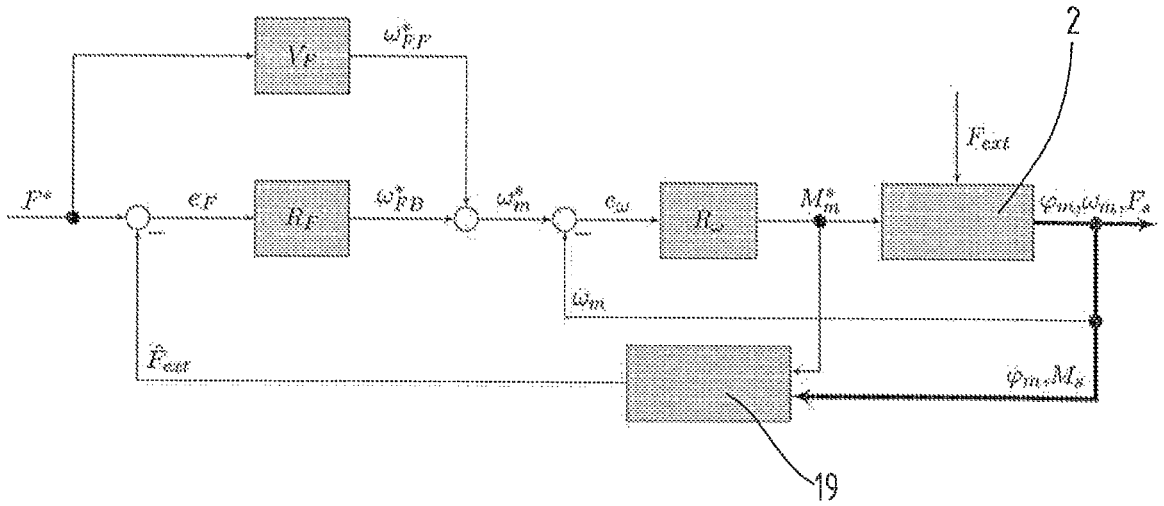
Figure 11:
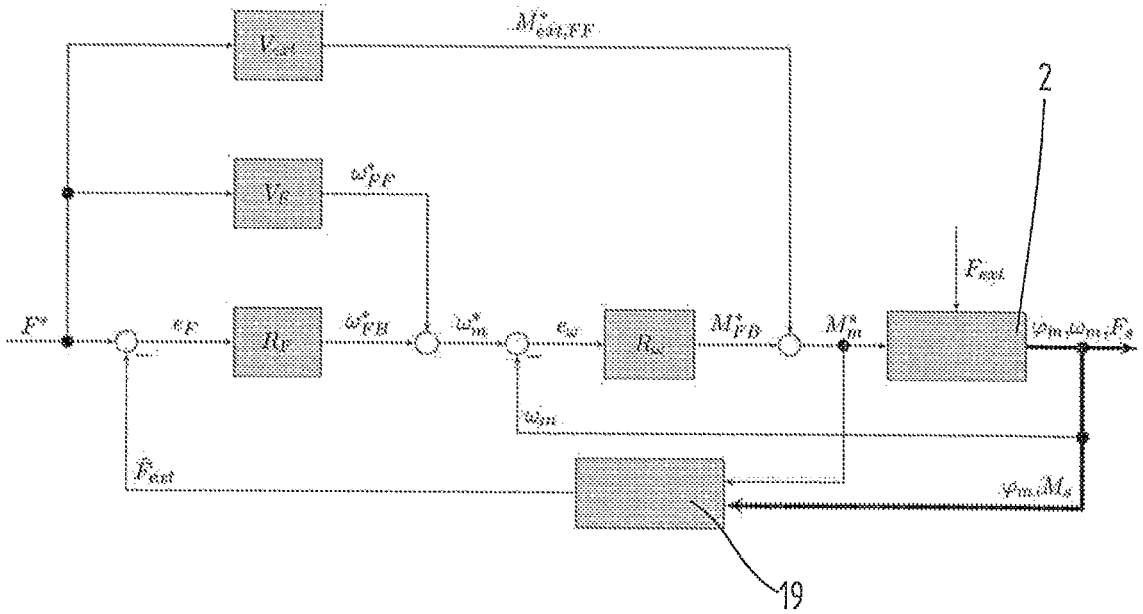
Figure 12:
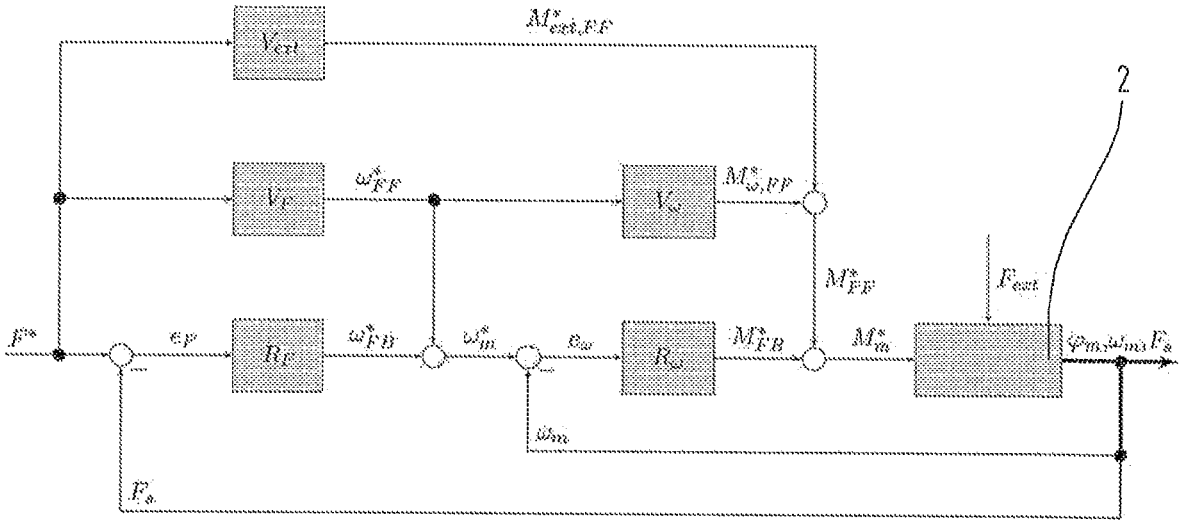
Figure 13:
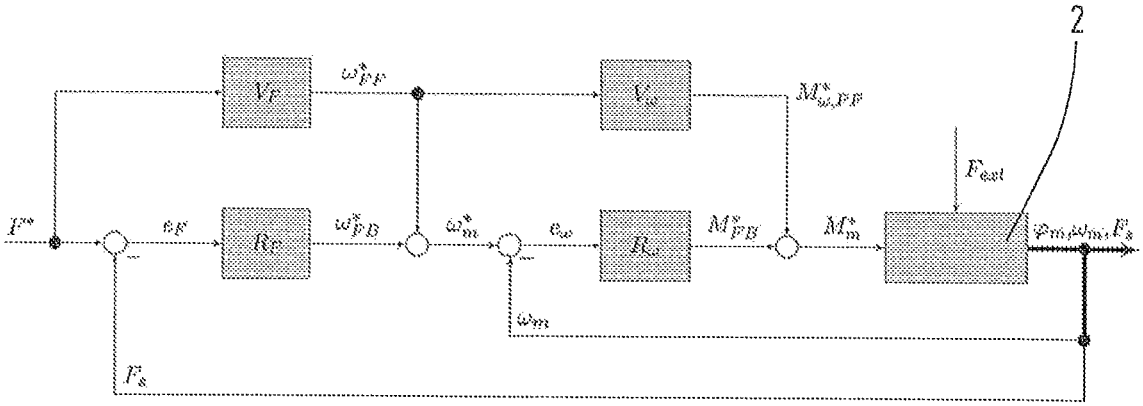
Figure 14:
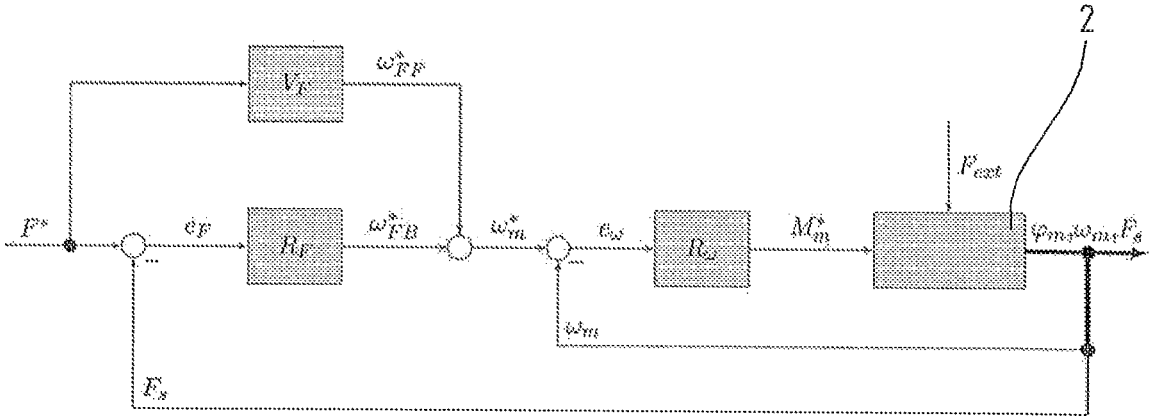
Figure 15:
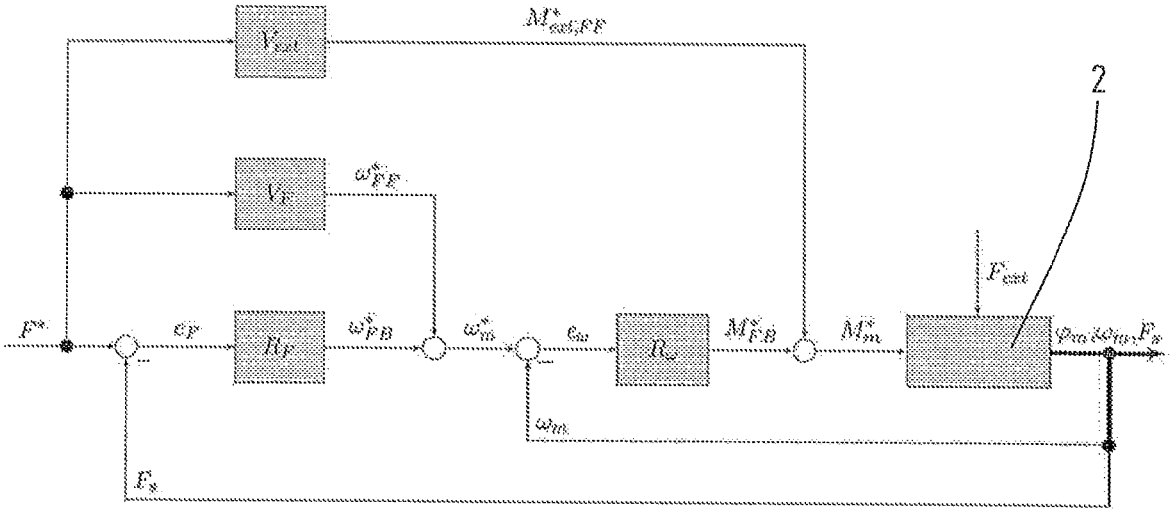

The figures show, each in a greatly simplified, schematic representation:

FIG. 1 a schematic representation of a possible structure of a press;

FIG. 2 a flow chart of a first regulation strategy for pressing of a workpiece;

FIG. 3 a structural circuit schematic of the mechanical model of the press;

FIG. 4 a force progression representation of the press;

FIG. 5 a structural circuit schematic of a regulation circuit for force regulation;

FIG. 6 an exemplary regulation distance of a force regulation unit;

FIG. 7 a flow chart of a further regulation strategy for pressing of a workpiece;

FIG. 8 a structural circuit schematic of a regulation circuit with interference variable observer and load pre-controller, force pre-controller, as well as inertia compensation;

FIG. 9 a structural circuit schematic of a regulation circuit with interference variable observer and force pre-controller as well as inertia compensation;

FIG. 10 a structural circuit schematic of a regulation circuit with interference variable observer and force pre-controller;

FIG. 11 a structural circuit schematic of a control circuit with interference variable observer and load pre-controller as well as force pre-controller;

FIG. 12 a structural circuit schematic of a control circuit with load pre-controller, force pre-controller, as well as inertia compensation;

FIG. 13 a structural circuit schematic of a control circuit with force pre-controller as well as inertia compensation;

FIG. 14 a structural circuit schematic of a control circuit with force pre-controller;

FIG. 15 a structural circuit schematic of a control circuit with load pre-controller as well as force pre-controller.

As an introduction, it should be stated that in the different embodiments described, the same parts are provided with the same reference symbols or the same component designations, wherein the disclosures contained in the entire description can be applied analogously to the same parts having the same reference symbols or the same component designations. Also, the position information chosen in the description, such as top, bottom, at the side, etc., for example, refer to the figure that is directly described or shown, and this position information must be transferred analogously to the new position in the case of a change in position.

FIG. 1 shows a schematic representation of a process press 1. The process press 1 comprises an electric motor 2, and a forming tool 3 coupled with the electric motor 2. The forming tool 3 can act on a workpiece 4 so as to be able to deform it. Such deformation can be embossing, for example. Furthermore, it is also conceivable that the workpiece 4 is bent, for example by means of the forming tool 3. The forming process of the workpiece 4 can take place in automated manner. The forming tool 3 can have the most varied shapes.

Furthermore, it can be provided that the electric motor 2 is structured as a servomotor. Such a servomotor can be a synchronous motor, for example. Furthermore, it can be provided that the electric motor 2 is connected with a regulator 5. Furthermore, it can be provided that a frequency inverter is formed, which interacts with the electric motor 2 and predetermines the speed of rotation of the electric motor 2.

As is further evident from FIG. 1, it can be provided that a spindle drive 6 is coupled with the electric motor 2. Such a spindle drive 6 can be configured as a threaded drive, for example, preferably as a ball screw drive. A ball screw drive has the advantage that it has low play. As a result, great precision of the process press 1 can be achieved.

By means of the spindle drive 6, the rotational movement of the electric motor 2 can be converted to a translational movement of the forming tool 3.

Furthermore, optionally it can also be provided that a gear mechanism 7 is disposed between spindle drive 6 and electric motor 2, by means of which the speed of rotation of the drive shaft 8 of the electric motor 2 can be stepped down.

If a gear mechanism 7 is provided in the drive train, then a spindle 9 of the spindle drive 6 is coupled with a gear mechanism output shaft 11 disposed on the gear mechanism output 10, and has the same speed of rotation as this shaft.

If no gear mechanism 7 is provided in the drive train, then the spindle 9 of the spindle drive 6 is coupled with the drive shaft 8 of the electric motor 2, and has the same speed of rotation as this shaft.

Furthermore, it is provided that a measuring unit 12 is disposed between spindle drive 6 and forming tool 3, which unit is configured for detecting the pressing force that is being applied to the forming tool 3. The measuring unit 12 can be configured, in particular, as a force sensor or as a force load cell. Preferably, it can be provided that the measuring unit 12 is configured as a Piezo sensor. The measuring unit 12 is coupled with the regulator 5.

Furthermore, it can be provided that a coupling 13 is provided for connecting electric motor 2 and gear mechanism 6 or for connecting gear mechanism 7 and spindle drive 6. The couplings 13 serve, in particular, for torque transfer between the individual components and are therefore disposed between the individual components.

Furthermore, it can be provided that the spindle 9 of the spindle drive 6 is mounted on a mounting 14, which serves for absorbing axial forces and radial forces introduced into the spindle 9. Furthermore, it can be provided that the spindle drive 6 comprises a threaded nut 15, which is coupled with the spindle 9 and converts the rotational movement of the spindle 9 to a translational movement of the threaded nut 15.

A carriage 16 can be coupled with the threaded nut 15, which carriage can serve to hold the forming tool 3. In particular, it can be provided that the measuring unit 12 is disposed between carriage 16 and forming tool 3.

In an embodiment variant that is not shown, it can be provided that the measuring unit 12 is integrated into the carriage 16.

Preferably, it can be provided that the forming tool 3 is coupled with the carriage 16 in removable manner. In this way, the result can be achieved that different forming tools 3 can be coupled with the carriage 16 for different usage requirements.

Furthermore, it can be provided that the carriage 16 is guided on a guide rail 17.

The general method of functioning of the process press 1 will now be explained using FIG. 1.

The forming tool 3 is moved toward the workpiece 4 by means of the spindle drive 6, wherein the spindle drive 6 is driven by the electric motor 2. In a first method step, in this regard, the forming tool 3 is moved freely toward the workpiece 4, wherein attention is paid to ensure that the forming tool 3 does not touch the workpiece 4. Stated in other words, this can also be spoken of as a setting process.

At the end of this setting process, a pressing surface 18 of the forming tool 3 comes into contact with the workpiece 4, and thereby the force acting on the forming tool 3 increases suddenly. Subsequently, the forming tool 3 is pressed into the workpiece 4, and thereby the workpiece 4 is deformed by means of the forming tool 3.

One can say that the pressing process is divided into two stages. The first stage is a setting process in which the forming tool 3 is moved freely toward the workpiece 4, but without touching it.

The second stage is a forming stage, in which the pressing surface 18 of the forming tool 3 lies against the workpiece 4 and the workpiece 4 is deformed by means of the forming tool 3, wherein increased torque needs to be applied to the drive shaft 8 of the electric motor 2.

During the setting process, it can be provided that the speed of the electric motor 2 can be regulated, in superimposed manner, until a predefined pressing force is exceeded or impact of the forming tool 3 on the workpiece 4 is detected using a gradient method. In the forming stage, it can be provided that the torque of the electric motor 2 can be regulated, in subordinate manner, wherein the measured pressing force serves for regulation of the electric motor 2.

In the forming stage, a predefined pressing force can be set using a cascaded regulator having two degrees of freedom. This cascaded regulator consists of an inner speed regulator, of a superimposed moment regulator or force regulator, and of a corresponding model-based pre-controller.

Using the model-based pre-controller, the pressing force that occurs is compensated to follow the load and the inertia of the drive. If the mechanical coupling between electric motor 2 and forming tool 3 is sufficiently stiff, then the pressing force detected at the measuring unit 12 can be used as a direct feed-back value for the moment regulator or force regulator.

The difficulty in regulation consists in keeping the process speed high and the pressing force within predetermined limits. If an ideal, interference-free segment is assumed, a progression of the motor speed of rotation can be found, which makes it possible to set a desired pressing force. In a real application case, however, interference and measurement noise must be expected in the measuring unit 12.

In order to achieve a defined pressing force and, at the same time, keep the process speed as high as possible, the regulation strategies according to the invention were developed.

As long as the forming tool 3 is moved freely toward the workpiece 4 and does not lie against it, no significant increase in the pressing force actually applied to the forming tool 3 is expected. It is therefore practical to directly set a motor speed of rotation profile without additional moment regulation or force regulation in this forming stage. Only once the pressing surface 18 of the forming tool 3 contacts the workpiece 4 does a rapid increase of the pressing force applied to the forming tool 3 occur, and the moment regulator or force regulator becomes active. In the forming stage, a motor speed of rotation profile is set, in which the different speed levels are constantly connected with one another. In this way, it is ensured that the mechanical components of the process press 1 are not subjected to unnecessary stress, and that excitation of vibrations in the system is kept low.

It is the goal of regulation to regulate the pressing force that is actually applied to the forming tool in such a manner that it achieves a defined value, also referred to as a predetermined pressing force.

The pressing force actually applied at the forming tool 3 is supposed to be measured using the measuring unit 12 and to serve as a feedback variable in regulation. However, it should be mentioned that the pressing force measured in the measuring unit 12 corresponds to the pressing force actually applied to the forming tool 3 only when the forming tool 3 is not being accelerated or braked at the time, and therefore dynamic effects occur on the basis of the mass inertia of the individual components. Stated in other words, the pressing force actually applied to the pressing tool 3 can be measured precisely by the measuring unit 12 when the forming tool 3 is at a standstill or is moving at a constant advancing speed, wherein this state also has to last for a certain period of time, so that vibrations have already died out.

FIG. 2 shows a flow chart of a schematic sequence of a first regulation strategy for pressing of the workpiece 4.

At decision paths, a plus (+) stands for condition has been met. A minus (−) stands for condition has not been met.

In method step 1, the drive shaft 8 of the electric motor 2 is accelerated to maximal speed of rotation. In order to accelerate the electric motor 2 to maximal speed of rotation, a specific time progression of the angular velocity or a specific acceleration ram can be set, by means of which the electric motor 2 is accelerated. In Query A, the question is asked whether the drive shaft 8 of the electric motor 2 has already completed a predetermined number of spindle revolutions, or, accompanying this, how far the forming tool 3 has already been moved by means of the spindle drive 6, in terms of its linear movement.

The electric motor 2 is operated at maximal speed of rotation until, in Query A, reaching the predetermined number of spindle revolutions or reaching the predetermined setting path of the forming tool 3 leads to fulfillment of the condition. The number of spindle revolutions that serves for a switch to the method step 2 is selected to be as high as possible, but so low that in all cases that are conceivable on the basis of the tolerance, it is guaranteed that the pressing surface 18 of the forming tool 3 does not come to lie against the workpiece 4 during this method step. During method step 1, it can be provided that the pressing force measured at the measuring unit 12 is not queried, or at least does not flow into the pressure regulation.

Subsequently, in method step 2, the electric motor 2 is operated at a reduced speed of rotation. The reduced speed of rotation serves to ensure that when a pressing force increase is detected in the measuring unit 12, sufficient time remains to reduce the motor speed of rotation or to change over to force regulation. The speed of rotation at the reduced speed of rotation is dependent on how quickly the electric motor 2 can be braked and the displacement path along which the forming tool 3 can still be displaced after it is set down onto the workpiece 4. This maximal displacement path is also called press-in depth. If the planned press-in depth is very great, for example, the reduced speed of rotation can have a high value, and can be approximately as great as the maximal speed of rotation, for example.

The transition from maximal speed of rotation to reduced speed of rotation can also take place in accordance with a predetermined time progression of the angular velocity. During operation of the electric motor 2 at a reduced speed of rotation, the measuring unit 12 is activated so as to be able to detect when the pressing surface 18 of the forming tool 3 comes into contact with the workpiece 4, whereby a sudden increase of the pressing force measured in the measuring unit 12 comes about. In Query B, it is determined whether the pressing force detected in the measuring unit 12 has reached a specific predefined threshold value, and when the threshold value is reached, method step 3 is initiated.

Subsequently, in method step 3, force regulation as shown in the structural circuit schematic of the control circuit in FIG. 5 with the regulation segment in FIG. 6 is activated. By means of the force regulation, the electric motor 2 is controlled in such a manner that the predetermined pressing force is reached.

FIG. 3 shows a structural circuit schematic of the mechanical model of the process press 1. This serves as a basis for modeling of the process press 1. The input variable of the model represents the motor moment $M_m$, which counteracts the friction moment $M_{rm}$ of the drive. The motor inertia moment is determined by $\theta_m$. The coupling 13 is modeled as a linear spring/mass damper element. This is characterized by the spring constant $c_k$, the damping constant $d_k$, and the inertia moment $\theta_k$, wherein the inertia moment is taken into consideration on the drive side and on the power take-off side, by half, in each instance. The moment after the coupling 13, which acts as the drive moment of the spindle 9, is referred to as $M_{sp}$. The friction losses are taken into consideration with the moment $M_{rs}$. $\theta_{sp}$ indicates the inertia moment of the spindle 9. The ball screw drive transforms the rotational movement of the spindle 9 to a translational movement of the carriage 16. The translation ratio of this transformation is indicated with $i_g$. The measuring unit 12, which connects the carriage 16 with the mass $m_1$ and the forming tool 3 with the mass $m_2$, is modeled with a linear spring/damper model having the spring constants $c_s$ and the damping constants $d_5$. The position of the carriage 16 is indicated with $s_1$ and the position of the forming tool 3 is indicated with $s_2$. The transformed spindle moment causes the force $F_a$, which acts on the carriage 16. The force $F_s$ indicates the measured value of the measuring unit 12, and $F_{ext}$ indicates the external force that occurs during pressing.

FIG. 4 shows an exemplary progression of the external force above the progression of the position of the forming tool 3. The exemplary progression of the external force can be determined by an experiment. This exemplary progression is also referred to as a load characteristic line.

In order to allow a wide field of pressing applications, and to guarantee simplicity of the model adaptation, the load model of the specific application cases is determined empirically. The goal is to detect a characteristic line using measurement technology, which line indicates the connection between the external force $F_{ext}$ and the position of the forming tool 3 $s_2$. For this purpose, the forming tool 3 is moved at a constant velocity, in accordance with the application case, so far toward the workpiece 4 until a defined limit force has been reached.

The relationship between force and path determined in this way is shown in FIG. 4 and corresponds to that of a non-linear spring having the form $F_{ext}(s_2)=k(s_2)*s_2$ with the position-dependent spring stiffness $k(s_2)$. The characteristic line is divided into two regions. While the forming tool 3 moves freely, no significant increase in force occurs. For this process, $F_{ext}$=ON is assumed. Only once the forming tool 3 impacts the workpiece 4 does a noticeable force increase come about. When this force increase $F_{ext}\approx F_e>F_{trigger}$ is detected, the forming stage begins. The related carriage position is indicated as $s_{trigger}$.

FIG. 5 shows a structural circuit schematic of a control circuit for force regulation, wherein the force regulator is designed for the forming stage and is active during this stage.

In the case of some pressing processes, it can happen that the curve of the pressing force has a very steep increase. Stated in other words, the pressing force increases steeply in the case of only a slight movement of the forming tool 3. Therefore it can be necessary for the forming tool 3 to be brought to a stop within a short distance, in order to be able to achieve a predetermined value of the pressing force. Due to the inertia of the system or due to the inertia of conventional regulation of the electric motor 2, however, it can occur that the dynamics of the subordinate speed of rotation regulator of the electric motor 2 is not sufficient for this braking maneuver.

In order to circumvent this problem, not only a force pre-controller but also a motor speed of rotation pre-controller is used for inertia compensation and load compensation. This expanded control circuit is shown in FIG. 5. Due to the great stiffness in the relevant frequency range, $\varphi_m=\varphi_{sp}=s_2/i_g$ is assumed for the design of the pre-controller and motor speed of rotation regulator, wherein $\varphi_m$ stands for the motor angle position of the electric motor 2, and $\varphi_{sp}$ stands for the spindle angle position of the spindle 9 of the spindle drive 6. At first, the translational total mass, i.e. $m_t=m_1+m_2$ is added up, in accordance with the translation ratio $i_g$, with the inertia moment of the drive train, to yield a total inertia moment $\theta=\theta_m+\theta_k+\theta_{sp}+m_t i_g^2$, wherein $\theta_m$ represents the inertia moment of the electric motor 2, $\theta_k$ represents the inertia moment of the coupling 13, and $\theta_{sp}$ represents the inertia moment of the spindle 9. This results in the simplified draft model $\theta_{\omega^*_m}=M^*_m-F_{ext}i_g$.

With $F^*=_{ext}$ and $M^*_{FF}=M^*_m$, the motor speed of rotation pre-control is consequently $M^*_{FF}=M^*_{\omega,FF}+M^*_{ext,FF}$. With the pre-control component $M^*_{\omega,FF}$, subsequently the influence of the inertia moments and masses of the press can be compensated during the acceleration phases. The pre-control component for compensation of the external force $F_{ext}$ is $M^*_{ext,FF}=F^*i_g$. If the assumption of high stiffness is not justified, this simplified system does not apply, and the pre-control components must be calculated using the system in FIG. 3.

A substitute model for the controlled system $G_{\omega^*_m,F_s}(s)$ is shown in FIG. 6. The transfer function $G_{\omega m}(s)$ with the motor moment $M_m$ as the input and the motor speed of rotation $\omega_m$ as the output forms the output feedback $\omega_m$ for the subordinate speed of rotation regulation circuit $$T_\omega(s)=\frac{R_\omega(s)}{1+R_\omega(s)G_{\omega m}(s)}$$

which, together with the transfer function $G_{Fs}(s)$ with the motor moment $M_m$ as the input and the sensor force $F_s$ as the output, depicts the entire controlled system $$G_{\omega^*_m,F_s}(s)=\frac{F_s}{\omega^*_m}=T_\omega(s)G_{Fs}(s)$$

from the reference speed of rotation $\omega^*_m$ as the input to the sensor force $F_s$ as the output. A low-pass filter of the third order, having the form $$R_F(s)=\frac{k_{FP}}{\left(1+\frac{s}{\omega_{Fg}}\right)^3}$$

is selected as a regulator. The limit frequency $\omega_{FG}$ and the amplification $k_{FP}$ are adapted in such a manner that stable behavior occurs for the closed control circuit. The regulator parameters can be set using a Loop Shaping method.

FIG. 7 shows a flow chart of a schematic progression of a further regulation strategy for pressing the workpiece 4, wherein the first two method steps are the same as in the flow chart according to FIG. 2.

In method step 3, the electric motor 2 is operated at a minimal speed of rotation. The minimal speed of rotation can be different from process to process, and is predetermined on the basis of the current process parameters. In extreme cases, it can actually be necessary that the minimal speed of rotation is equal to zero or approaches zero. Braking from the reduced speed of rotation to the minimal speed of rotation should take place, within the scope of the strength values of the process press 1, as quickly as possible or abruptly. In method step 3, the electric motor 2 is operated at the minimal speed of rotation for such a time until the vibrations in the drive train, which occur due to the abrupt braking maneuver, have died out. For this purpose, a pre-calculated time period until the vibrations have died out is queried in Query C.

In an alternative variant, it can also be provided that the required time period until the vibrations have died out is not calculated on the basis of a model, but rather that this period is adapted in an iterative method, or that dying out of the vibrations is determined by means of detecting the motor torque in the electric motor 2 in comparison with the measured torque in the measuring unit 12.

Subsequently, in method step 4, force regulation as it is shown in the structural circuit schematic of the control circuit in FIG. 4 or in the controlled system in FIG. 5 is activated. By means of the force regulation, the electric motor 2 is controlled in such a manner that the predetermined pressing force is reached.

In FIGS. 8 to 14, different structural circuit schematics of possible control circuits for force regulation are shown. In order to avoid unnecessary repetition, reference is made to FIG. 5 and to the respective preceding figures.

In the exemplary embodiment according to FIG. 8, it is not the sensor signal Fs, as is the case in FIG. 5, that serves as the input variable for the force regulator $R_F$, but rather an estimated force $\hat{F}_{ext}$ made available by an interference variable observer 19 is an input variable for the force regulator $R_F$. Furthermore, a force pre-controller $V_F$, a load pre-controller $V_{ext}$, and an inertia compensation $V_\omega$, are provided.

In the exemplary embodiment according to FIG. 9, a force $\hat{F}_{ext}$ estimated by the interference variable observer 19 serves as an input variable for the force regulator $R_F$. Furthermore, a force pre-controller $V_F$ and an inertia compensation $V_\omega$ are provided.

In the exemplary embodiment according to FIG. 10, a force Kraft $\hat{F}_{ext}$ estimated by the interference variable observer 19 serves as the input variable for the force regulator $R_F$. Furthermore, a force pre-controller $V_F$ is provided.

In the exemplary embodiment according to FIG. 11, a force $\hat{F}_{ext}$ estimated by the interference variable observer 19 serves as an input variable for the force regulator $R_F$. Furthermore, a force pre-controller $V_F$ and a load pre-controller $V_{ext}$ are provided.

In the exemplary embodiment according to FIG. 12, the sensor signal Fs serves as an input variable for the force regulator $R_F$. Furthermore, a force pre-controller $V_F$, a load pre-controller $V_{ext}$, and an inertia compensation $V_\omega$ are provided.

In the exemplary embodiment according to FIG. 13, the sensor signal Fs serves as the input variable for the force regulator $R_F$. Furthermore, a force pre-controller $V_F$ and an inertia compensation $V_\omega$ are provided.

In the exemplary embodiment according to FIG. 14, the sensor signal Fs serves as the input variable for the force regulator $R_F$. Furthermore, a force pre-controller $V_F$ is provided.

In the exemplary embodiment according to FIG. 15, the sensor signal Fs serves as the input variable for the force regulator $R_F$. Furthermore, a force pre-controller $V_F$ and a load pre-controller $V_{ext}$ are provided.

The exemplary embodiments show possible embodiment variants, wherein it should be noted at this point that the invention is not restricted to the specifically shown embodiment variants of the same, but rather, instead, diverse combinations of the individual embodiment variants with one another are also possible, and this variation possibility lies within the ability of a person skilled in the art of this field, on the basis of the teaching for technical action provided by the present invention.

The scope of protection is determined by the claims. However, the description and the drawings should be used to interpret the claims. Individual characteristics or combinations of characteristics from the different exemplary embodiments that are shown and described can represent independent inventive solutions on their own. The task on which the independent inventive solutions are based can be derived from the description.

All the information relating to value ranges in the present description should be understood to mean that this information comprises any and all partial ranges of them for example, the statement 1 to 10 should be understood to mean that all partial ranges, proceeding from the lower limit 1 and including the upper limit 10 are included, i.e. all partial ranges begin with a lower limit of 1 or more and end at an upper limit of 10 or less, for example 1 to 1.7, or 3.2 to 8.1, or 5.5 to 10.

For the sake of good order, it should be pointed out, in conclusion, that for a better understanding of the structure, some elements were represented not to scale and/or enlarged and/or reduced in size.

REFERENCE SYMBOL LISTING

1 process press
2 electric motor
3 forming tool
4 workpiece
5 regulator
6 spindle drive
7 gear mechanism
8 drive shaft
9 spindle
10 gear mechanism output
11 gear mechanism output shaft
12 measuring unit
13 coupling
14 mounting
15 threaded nut
16 carriage
17 guide rail
18 pressing surface
19 interference variable observer

The invention claimed is:

1. A method for pressing a workpiece with a predetermined pressing force, using a forming tool, which is coupled by way of a gear mechanism with an electric motor, wherein the gear mechanism converts the rotational movement of a drive shaft of the electric motor to a translational movement of the forming tool, and wherein the electric motor is controlled by a closed loop controller, wherein the method comprises the following method steps:

accelerating the electric motor in a first direction of rotation, to a predetermined maximal speed of rotation, whereby the forming tool is moved toward the workpiece;

operating the electric motor at the maximal speed of rotation until the drive shaft of the electric motor has completed a predetermined number of spindle revolutions or the forming tool has reached a predetermined position, wherein during this method step, the forming tool is freely moved toward the workpiece, without touching the workpiece;

reducing the speed of rotation of the electric motor to a predetermined reduced speed of rotation;

operating the electric motor at the reduced speed of rotation until a pressing force increase is detected by a measuring unit coupled to the electric motor, which increase exceeds a predetermined threshold value, wherein the pressing force increase occurs when the forming tool comes to lie against the workpiece to be formed, wherein after detection of the pressing force increase, the electric motor is braked to a predetermined minimal speed of rotation; and forming the workpiece with constant detection of the pressing force by the measuring unit until the predetermined pressing force has been reached.

2. The method according to claim 1, wherein the electric motor is operated at the minimal speed of rotation for a predetermined or predeterminable period of time, until vibrations that occur in the drive system due to the braking process from the reduced speed of rotation to the minimal speed of rotation have died out.

3. The method according to claim 1, wherein during forming of the workpiece, control of the electric motor is set by the closed loop controller on the basis of the pressing force measured in the measuring unit.

4. The method according to claim 1, wherein the reduced speed of rotation amounts to between 0.1% and 100% of the maximal speed of rotation.

5. The method according to claim 1, wherein directly after detection of the pressing force increase, further control of the electric motor is set by the closed loop controller on the basis of the pressing force, wherein when the electric motor is braked to the predetermined minimal speed of rotation, in an initial period during the braking process, a pressing force based on a model calculation is used in place of the pressing force detected in the measuring unit as an input variable for the closed loop controller, and after the initial period, the pressing force detected by the measuring unit serves as the input variable for the closed loop controller.

6. The method according to claim 5, wherein in the model calculation, at least one of the mass inertia, the spring stiffness, the damping, and the angular or linear accelerations of the gear mechanism, the electric motor, and couplings is taken into consideration.

7. The method according to claim 5, wherein the model calculation is adapted on the basis of previous cycles of pressing the workpiece with the forming tool, in an iterative learning process, wherein for adaptation of the model calculation, the Time Progression of the measured value of the pressing force in the measuring unit, as well as of the motor moment and of the related angle of rotation of the drive shaft in the electric motor are used.

8. The method according to claim 5, wherein for the model calculation, an interference variable observer is used.

9. The method according to claim 8, wherein the actual force estimated in the interference variable observer is used in place of the force detected in the measuring unit for the model calculation.

10. The method according to claim 1, wherein a Piezo sensor is used as the measuring unit, wherein said Piezo sensor is disposed in the region of the forming tool, so as to detect the pressing force.

11. The method according to claim 1, wherein directly after detection of the pressing force increase, further control of the electric motor is set by the closed loop controller on the basis of a reference trajectory of the pressing force value, wherein the speed of rotation progression is calculated by a pre-controller, from the reference trajectory of the pressing force value.

12. The method according to claim 11, wherein in a first phase after detection of the pressing force increase, the pressing force value is estimated by means of an interference variable observer, and wherein in a second phase after detection of the pressing force increase, the pressing force is detected directly by the measuring unit, and serves as an input variable for the closed loop controller.

13. The method according to claim 1, wherein the transition between different speeds of rotation of the individual method steps is set in such a manner that no sudden increases in acceleration occur.

* * * * *